US005269612A

United States Patent [19]

Shimoha et al.

[11] Patent Number: 5,269,612

[45] Date of Patent: Dec. 14, 1993

[54] RIBBON CARTRIDGE

[75] Inventors: Masaki Shimoha; Shuji Sato; Kenichi Fukahori, all of Kanagawa; Hideki Ito; Shin Iima, both of Tokyo; Mutsuko Narita, Kanagawa, all of Japan

[73] Assignee: Sony Corporation, Japan

[21] Appl. No.: 895,697

[22] Filed: Jun. 9, 1992

[30] Foreign Application Priority Data

Jun. 19, 1991 [JP] Japan ..... 3-147034

[51] Int. Cl.[5] ..... B41J 35/28

[52] U.S. Cl. ..... 400/207; 400/238; 400/613

[58] Field of Search ..... 400/207, 238, 208, 613, 400/613.1

[56] References Cited

U.S. PATENT DOCUMENTS

| | | | |
|---|---|---|---|
| 3,627,118 | 12/1971 | Duggs | 400/207 |
| 3,809,218 | 5/1974 | Furst | 400/238 |
| 4,475,830 | 10/1984 | Schaefer | 400/238 |
| 4,716,145 | 12/1987 | Vanier et al. | 503/227 |
| 4,774,224 | 9/1988 | Campbell | 583/227 |
| 4,901,090 | 2/1990 | Ozawa et al. | 400/120 |
| 4,904,100 | 2/1990 | Enix | 400/613 |
| 4,970,531 | 11/1990 | Shimizu et al. | 400/208 |
| 5,089,897 | 2/1992 | Curley | 400/613 |

FOREIGN PATENT DOCUMENTS

| | | | |
|---|---|---|---|
| 3932999 | 4/1990 | Fed. Rep. of Germany . | |
| 2309339 | 11/1976 | France . | |
| 3-230984 | 10/1991 | Japan | 400/238 |

OTHER PUBLICATIONS

Patent Abstract of Japan, vol. 13, No. 33, 25 Jan. 1989; JP-A-63 242 669 (Fujitsu General Ltd) 7 Oct. 1988.

Patent Abstract of Japan, vol. 12, No. 182, 27 May 1988; JP-A-62 292 469 (Conon Inc.) 19 Dec. 1987.

Patent Abstract of Japan, vol. 11, No. 234, 30 Jul. 1987, JP-A-62 46 668 (Sony Corp) 28 Feb. 1987.

*Primary Examiner*—Edgar S. Burr

*Assistant Examiner*—Lynn D. Hendrickson

*Attorney, Agent, or Firm*—Ronald P. Kananen

[57] ABSTRACT

A ribbon cartridge comprises a substantially cylindrical cartridge body comprised of upper and lower casing halves. A ribbon supply reel is rotatably housed in the cartridge body having an ink ribbon wound therearound. Affixed to a leading edge of the ink ribbon, a pull sheet is attached which includes an opening allowing easy chucking of the ribbon cartridge in a printer. Also provided on the pull sheet are cut-out portions so arranged as to prevent creasing of the ink ribbon during use. When the ink ribbon has been completely used, the used ribbon is retracted back into the cartridge for easy removal from the printer.

18 Claims, 9 Drawing Sheets

RIBBON CARTRIDGE

BACKGROUND OF THE INVENTION

1. Field of The Invention

The present invention relates generally to a ribbon cartridge. Particularly, the present invention relates to a ribbon cartridge which may be employed in a color printer, for example.

2. Description of The Prior Art

A ribbon cartridge is well known in which a ribbon is permeated with colors, such as yellow, magenta and cyan for continuous color printing. Such a conventional ribbon cartridge includes a ribbon supply reel and a ribbon take-up reel winding a ribbon therebetween. Referring to FIGS. 13 and 14, such a conventional ribbon cartridge will be described hereinbelow in detail.

A ribbon cartridge 100 includes a cartridge body 101 comprised of a lower casing 102 and an upper casing 103, joined by ultrasonic welding or the like. The lower casing 102 comprises at the sides thereof, straight portions 102*a* and 102*b*, situated between curved end portions 102*c* and 102*d*. The straight and curved portions are formed integrally of synthetic resin or the like. The upper casing 103 likewise has corresponding straight side members 103*a* and 103*b* as well as semicircular end members 103*c* and 103*d* corresponding to the curved portions 102*c* and 102*d* of the lower casing 102. One each side of a central area of the upper casing 103, edge portions 102*e*, 103*e* are provided for defining an opening 106 for exposing a ribbon.

Between the end portions 102*c*, 103*c* and 102*d* and 103*d* of the lower and upper casings a ribbons supply reel 110 and a ribbon take-up reel 111 are provided respectively. Wound between the supply reel 110 and take-up reel 111 is an ink ribbon 120 permeated with yellow (Y), magenta (M) and cyan (C) inks, or dyes for example. Further, substantially centered within the circle formed by end portions 102*c*, 103*c*, and 102*d*, 103*d*, on the same side of the cartridge as the side members 103*a* and 102*a* rotational axis portions 104, 104 are mounted. Also, substantially centered within the circle formed by end portions 102*c*, 103*c*, and 102*d*, 103*d*, on the same side of the cartridge as the side members 103*b* and 102*b* rotational axis portions 105, 105 are mounted. The axis portions 104, 105 are axially aligned across the circular reel housings formed by the casing portions 102*c*, 103*c* and 102*d* and 103*d* respectively. One axis portion 104 and one axis portion 105 is required for rotatably mounting one of the reels 110 or 111 therebetween.

In the above described conventional ribbon cartridge 100, since the cartridge encloses both supply and take-up reels 110 and 111 housed in end portions 102*c*, 103*c* and 102*d* and 103*d* of the casings 102 and 103, the size of the cartridge become large and increases a manufacturing cost thereof. Further, the large size and double reel configuration make correct installation and removal more difficult. Further, openings 106, 106 defined between edge portions 102*e* and 103*e* on both supply and take-up sides of the cartridge body 101 must be substantially large and may easily admit dust etc., which may degrade image quality and/or printer performance. Also, the take up reel preserves the images printed by the printer on the spent ink ribbon 120 which may compromise the security of documents printed on the printer in which such a cartridge is employed.

SUMMARY OF THE INVENTION

It is therefore a principal object of the present invention to overcome the drawbacks of the prior It is further object of the present invention to provide a ribbon cartridge which is compact, inexpensive and resists intrusion by dust etc., into the cartridge body.

In order to accomplish the aforementioned and other objects, a ribbon cartridge is provided, comprising: an upper casing including ribbon guide means projecting therefrom in an extraction direction of ink ribbon to be employed in the cartridge; a lower casing, including ribbon guide means projecting therefrom in the extraction direction and corresponding positionally with the ribbon guide means of the upper casing, the upper and lower casings joinable to form a substantially cylindrical cartridge body; a ribbon supply reel rotatably mounted between and longitudinally enclosed by the upper and lower casings; biasing means for exerting axial force against the ribbon supply reel in a predetermined direction; an ink ribbon, wound around the ribbon supply reel; a ribbon supply opening defined between the ribbon guide means of the upper and lower casings; extraction enabling means affixed to an outer, exposed end of the ink ribbon, the extraction enabling means projecting outside of the cartridge body in an initial arrangement of the ribbon cartridge; chucking means associated with the extraction enabling means; and anti-creasing means associated with the extraction enabling means.

The preceding and other objects, features, and advantages of the present invention will become apparent from the following detailed description of an illustrative embodiment thereof when read in conjunction with the accompanying drawings, in which like reference numerals are used to identify the same or similar parts in the several views.

DESCRIPTION OF THE PREFERRED EMBODIMENT

Figure 1:
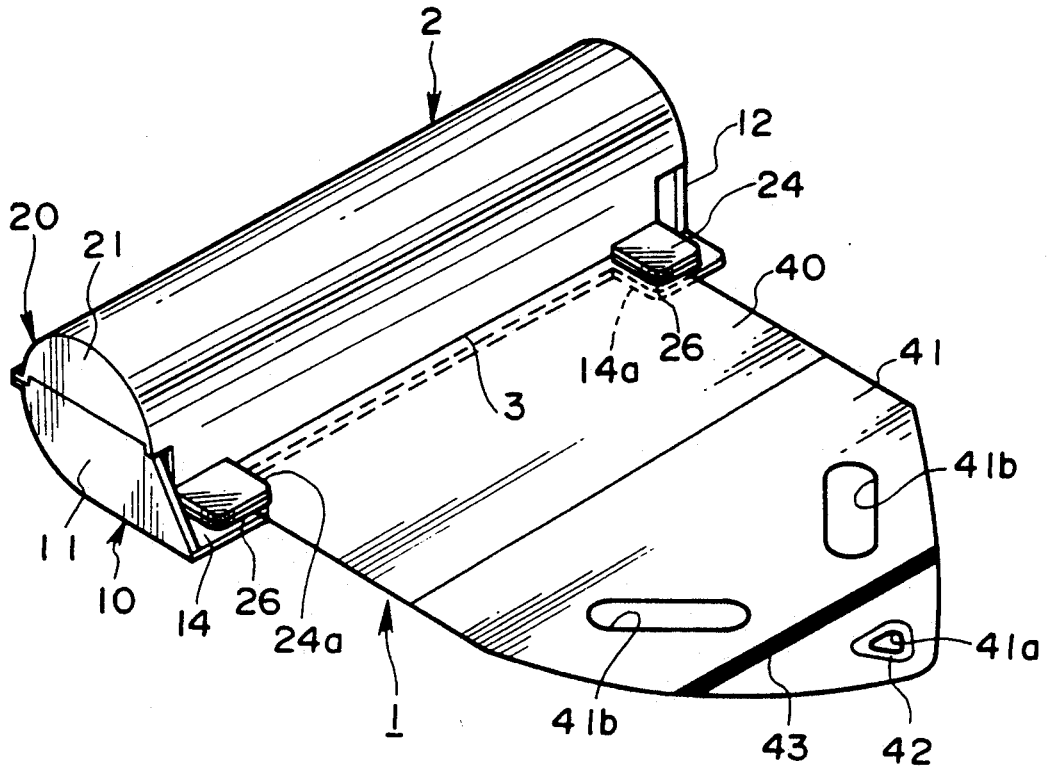
FIG. 1 is a perspective view of a first embodiment of the ribbon cartridge of the invention.

Referring now to the drawings, particularly to FIGS. 1–4, a ribbon cartridge 1 according to the present invention comprises a cartridge body 2 including a lower casing 10 and an upper casing 20, which may be joined by ultrasonic welding, or the like. Further, within the upper and lower casings 10 and 20, a rotatably mounted supply reel 30 is provided having an ink ribbon 40 wound therearound.

The lower casing includes first and second side portions 11 and 12 which are curved symmetrically at the bottom and rear edges thereof. Projecting horizontally from the lower casing 10, along the bottom edge thereof a ribbon guide portion 14 is provided. The ribbon guide portion 14 projects horizontally from an arc shaped ribbon supply portion 13 formed by the curved inner surface of the lower casing 10.

Figure 2:
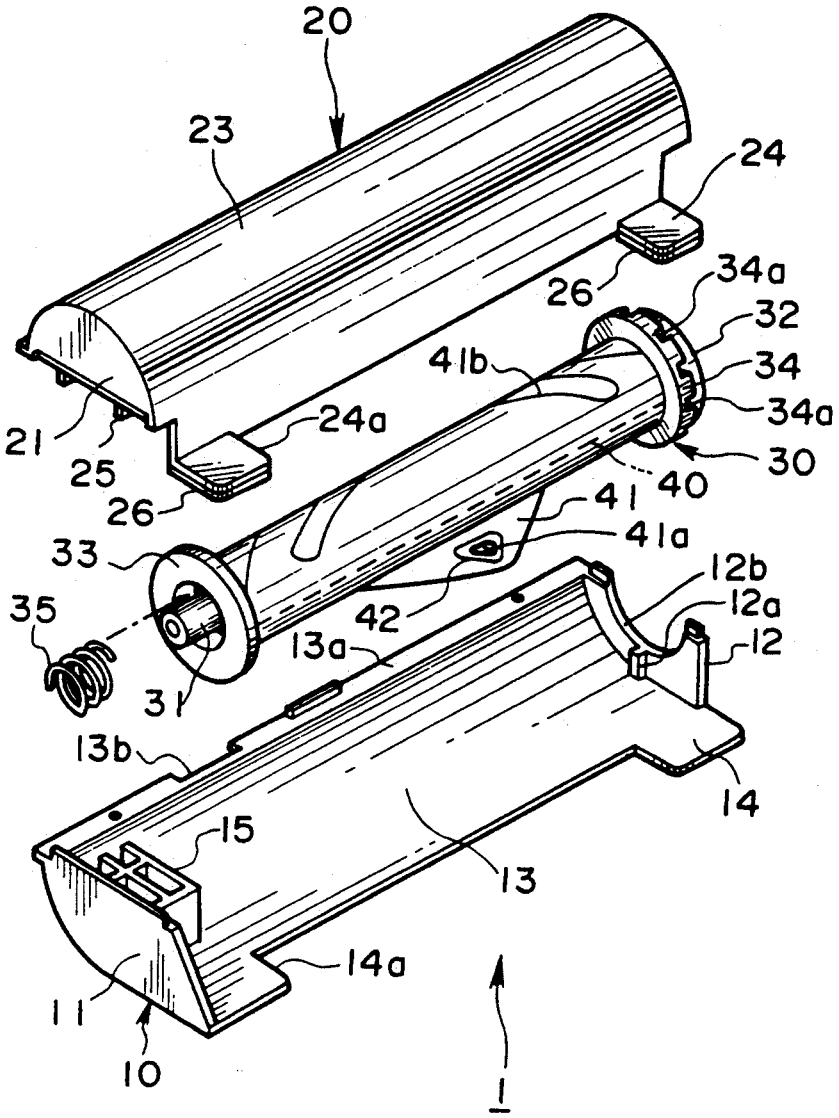
FIG. 2 is an exploded perspective view of the ribbon cartridge of FIG. 1.

Referring to FIG. 2, at an inner side of the first side portion 11 a reel support portion 15 is formed for rotatably supporting the supply reel 30 thereon. According to the present embodiment, the reel support portion 15 is formed integrally with the lower casing 10. At the second side portion 12, on an upper surface thereof, a semicircular cut-out 12*b* is defined and, below the semicircular cut-out 12*b*, a rib 12*a* is formed which projects into the interior space of the lower casing 10. Further, an opening is defined in the in the lower casing by a rectangular cut-out 14*a* formed in a substantially center area of the ribbon guide 14.

The upper casing 20 includes first and second side portions 21 and 22 formed for mating with the first and second side portions 11 and 12 of the lower casing 10. The upper surface of the upper casing 20 is formed as a half (semicircular) cylindrical ribbon supply surface 23 for joining with the arc shaped ribbon supply portion 13 of the lower casing 10 for providing a substantially circular housing for the supply reel 30.

Extending horizontally from the front of the upper ribbon supply surface 23, an upper ribbon guide portion 24 is formed opposing the ribbon guide portion 14 of the lower casing. The upper ribbon guide portion 24 has a rectangular cut-out portion 24*a* corresponding to the cut-out 14*a* of the lower casing 10. When the lower and upper casings 10, 20 are joined, the ribbon guide portions 14, 24 combine to form a ribbon supply opening 3.

Figure 4:
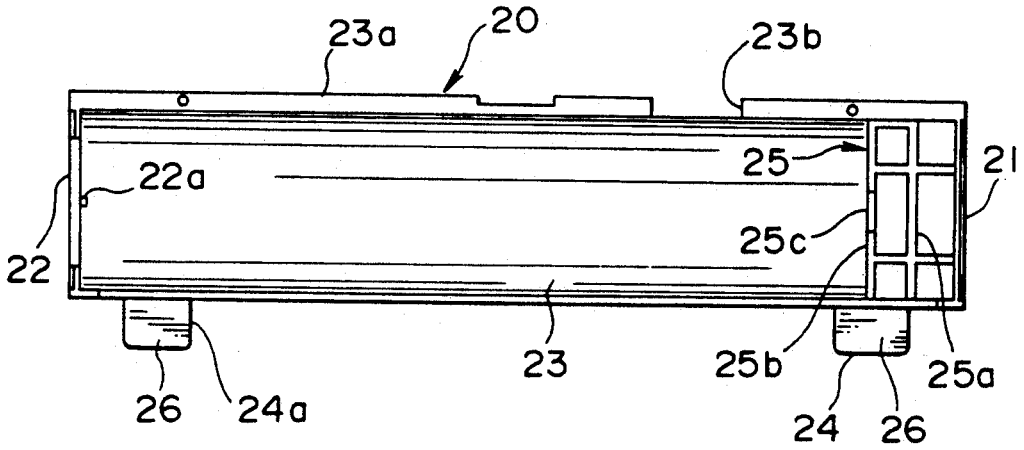
FIG. 4 is a cut-away view of a casing member of the ribbon cartridge of FIG. 1.

Referring now to FIG. 4, at the first side 21 of the upper casing a reel support portion 25 is formed corresponding to the support portion 15 of the lower casing 10. As with the lower casing 10, the upper reel support portion 25 may be formed integrally with the casing. The support portion 25 of the upper casing includes wall portions 25*a* and 25*b*. The wall portion 25*b* has a cut-out portion 25*c* for receiving an end portion of the supply reel 30. The second side portion 22 of the upper casing 20 has a semicircular cut-out 22*b* reciprocating the cut-out 12*b* of the lower casing and a rib 22*a* projecting into the interior space of the upper casing 20. When the lower and upper casings 10, 20 are joined the semicircular cut-outs 12*b* and 22*b* form a circular opening supporting a driven side of the supply reel 30 as shall be explained fully hereinlater. Further, on a lower surface of the ribbon guide 24, on both sides thereof, so as to face the upper surface of the lower ribbon guide 14, resilient pads 26, 26, of rubber for example, are provided to prevent the ink ribbon 40 from being undesirably retracted back into the cartridge casing after extraction. Alternatively, the resilient pads 26, 26 may be provided on both sides of the upper surface of the lower ribbon guide 14.

Furthermore, on the rear side of the lower casing 10 projecting horizontally outward of the interior space of the lower casing from the top edge of the ribbon supply portion 13, a shelf portion 13*a* including a rectangular cut-out 13*b* is provided. Correspondingly, at a rear lower edge of the ribbon guide surface 23, projecting outwardly of the interior space of the upper casing 20, left and right upper shelf portions 23*a* and 23*b* are formed. The upper and lower shelf portions 13*a*, 13*b* and 23*a*, 23*b* mutually correspond for allowing secure joining of the upper and lower casings by ultrasonic welding, for example.

Figure 5:
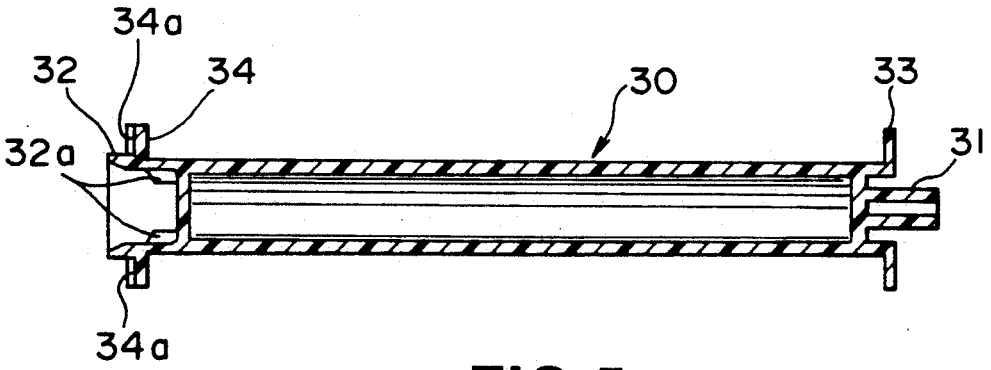
FIG. 5 is a cross-sectional view of a ribbon supply reel.
Figure 6:
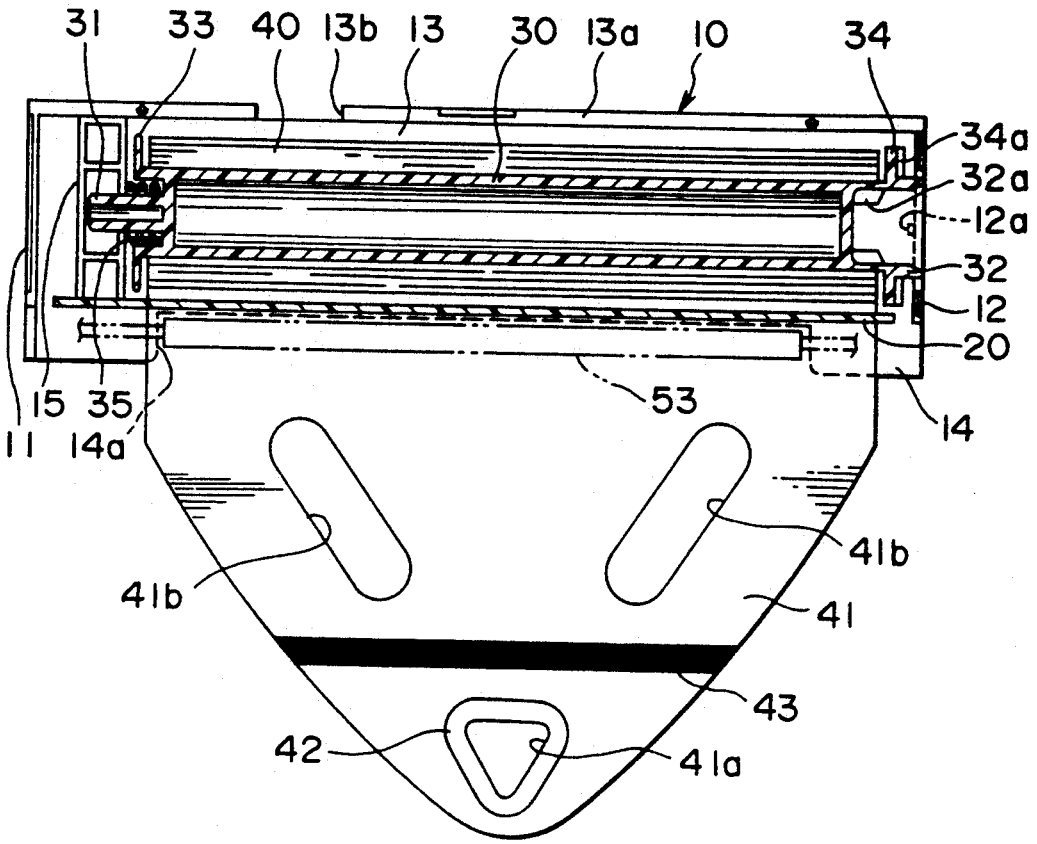
FIG. 6 is a cut-away view of the lower casing of the ribbon cartridge.
Figure 7:
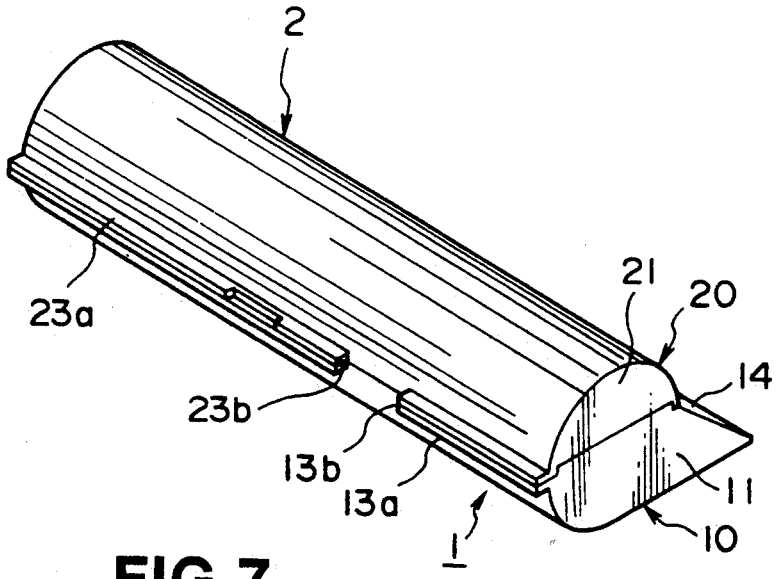
FIG. 7 is a rear perspective view of the cartridge casing.

When the lower and upper casings 10, 20 are joined, end portions 31, 32 of the ribbon supply reel 30 are rotatably supported by the support portions 15 and 25 and semicircular cut-outs 12*b* and 25*c* respectively. Referring to FIGS. 5 and 6, on one side of the supply reel 30, a compressed coil spring 35 is installed between the wall 25*a* and a circumferential ridge portion 33 formed around the end portion 31 of the supply reel. In a depression formed in the other end portion 32 of the supply reel 30, rib portions 32*a*, 32*a* are formed for interlocking with a driving source as will be discussed hereinlater. The end portion 32 of the supply reel 30 further includes a circumferential ridge portion 34 including cut-outs 34*a* spaced evenly therearound for interlocking with the rib portions 12*a* and 22*a* of the ends 12 and 22 of the lower and upper casings 10, 20 according to the spring force of the coil spring 35 installed at the end portion 31 of the supply reel. According to this arrangement, when the end portion 32 of the supply reel is pressed inwardly, against the spring force of the coil spring 35, the supply reel is freely rotatable for extracting a length of ink ribbon 40 from the cartridge casing. When the end portion 32 is not pressed, rotation of the supply reel 30 is prevented according to the spring force of the coil spring 35 and the interlocking of the rib portions 12*a*, 22*a* with the cut-outs 34*a* of the circumferential ridge portion 34.

Figure 3:
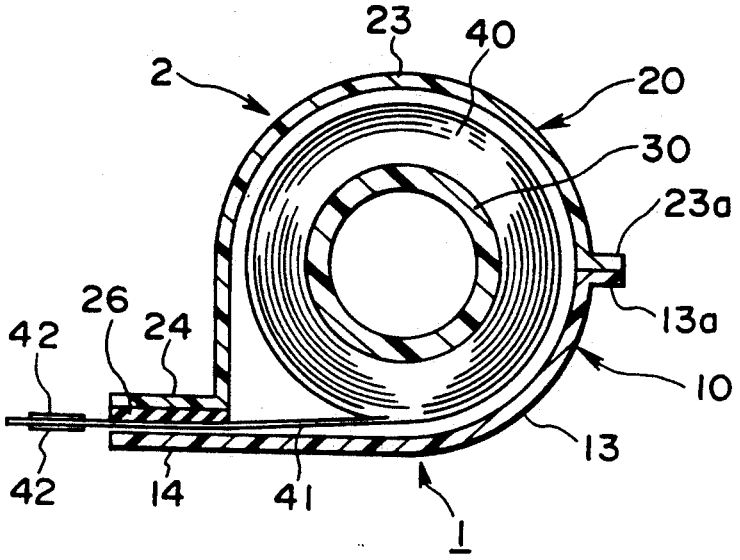
FIG. 3 is a cross-sectional view of the ribbon cartridge of FIG. 1.

As mentioned hereinabove, the ink ribbon 40 is wound around the supply reel 30. At the leading (starting) edge of the ink ribbon 40 a pull sheet 41 is attached. The pull sheet 41 may be formed of polyester for example and, according to a first embodiment as seen in FIG. 1, may be V-shaped at the leading end thereof. The pull sheet 41 is designed for being extracted from the ribbon cartridge for being wound around a ribbon take up reel 58 of a printer 50, which may, for example, be a color printer. The pull sheet 41 includes a triangular pull opening 41*a*. As seen in FIG. 3, the triangular opening 41*a* is reinforced by triangular ring members 42, affixed at upper and lower sides of the triangular opening 41*a*, the ring members 42, 42 also prevent the end of the pull sheet from being drawn into the cartridge body 2. Further, for preventing creasing or wrinkling of the ink ribbon 40, cut-out portions 41*b* are provided, symmetrically arranged on left and right sides of the pull sheet 41. Referring again to FIG. 1, according to the present embodiment, the cut-out portions 41*b* are angled toward the center of the pull sheet, parallel to the V-shaped leading edges of the pull sheet 41. Also, a marker 43 is provided on the pull sheet for enabling detection of a winding position of the pull sheet, the marker may, for example, be black in color.

Figure 8:
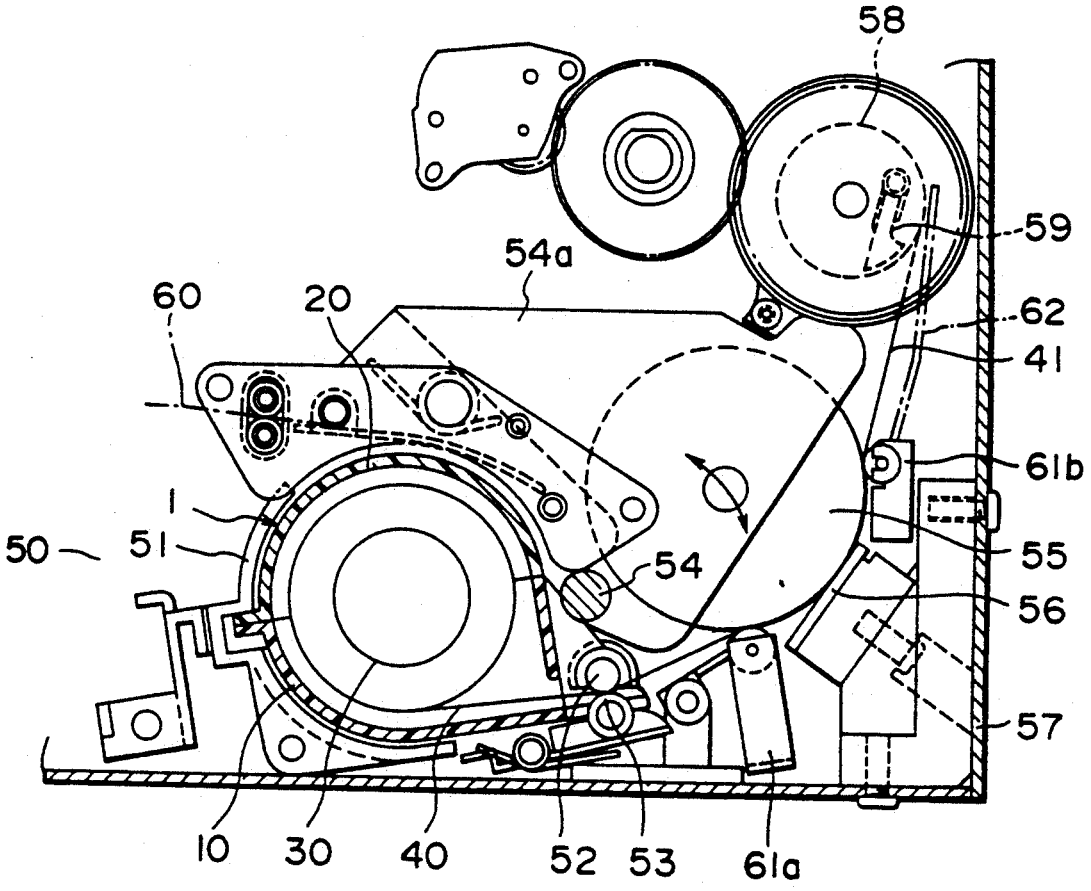
FIG. 8 is a cross-sectional view showing the ribbon cartridge as installed in a color printer.

FIG. 8 shows the ribbon cartridge 1 of the invention installed in a color printer 50. The color printer includes a cartridge receiving portion 51, a rotatable capstan 52, a pinch roller 53, a movable plate 54*a* movable on an axis 54, a platen 55 is rotatably mounted on the movable plate 54*a* so as to be positionally shiftable according to movement thereof, a thermal head 57 mounted on a chassis 56, the ribbon take up reel 58 as mentioned above, and in a substantially center portion of the take up reel 58, a hook 59 is provided.

The platen 55 of the color printer 50 is mounted so as to oppose the thermal head 56 in a downwardly shifted position thereof and, to be separated from the thermal head 56 in an upwardly shifted position thereof.

Thus, according to the above description, an operation by which the ribbon cartridge 1 is utilized by the color printer 50 will be described hereinbelow with reference to FIG. 8.

First, the ribbon cartridge 1 is loaded into the cartridge receiving portion 51, by hand, for example. Then, the pull sheet 41 of the ribbon 40 is extracted from the cartridge body 2 between the capstan 52 and the pinch roller 53 according to rotation thereof. The extracted pull sheet is guided up between the platen 55 and rollers 61*a* and 61*b* to the ribbon take up reel 58. A guide plate 62 is provided to ensure correct positioning of the pull sheet 41 proximate the take up reel 58. In this state, the marker 43 is detected by a sensor (not shown) of the color printer and the hook 59 catches the pull opening 41*a*, at which time the pull sheet is wound around the take up reel, extracting a predetermined length of ink ribbon 40 from the cartridge body 2 thus completing a chucking operation for the ink cartridge 1. When the ink ribbon 40 is suitably positioned in the printer, image paper 60 is then supplied for printing an image thereon. Further, when the ink ribbon 40 in the cartridge body 2 is completely used, the ribbon supply reel 30 and the take up reel 58 may be driven in reverse for retracting the used ribbon back into the cartridge body 2, allowing easy extraction of the cartridge and ribbon from the cartridge receiving portion 51.

Thus, according to the above-described embodiment, wherein a single supply reel only is provided in a cartridge body for use in a color printer, the cartridge design is advantageously simplified and may be made substantially smaller than conventional cartridges. Further, the cost of manufacturing the cartridge is reduced and color images may be produced at lower cost. In addition, due to the single, cylindrical shape of the cartridge body, the cartridge is stronger than conventional cartridges to resist breakage due to dropping, packing etc. Also, since the ribbon supply opening is considerably smaller than that of conventional cartridges, twisting and/or tearing of the ink ribbon as well as introduction of dust etc., into the cartridge body is suitably prevented.

Additionally, according to the first embodiment shown in FIG. 1, since the pull sheet projects slightly from the cartridge casing initially, extraction of the ink ribbon is easier according to the present invention and, by provision of the cut-out portions 41*b*, 41*b* in the pull sheet 41, the ink ribbon may be extracted smoothly without occurrence of wrinkles or creasing of the ink ribbon. With the triangular cut-out 41*a* provided at the leading edge of the pull sheet, chucking of the ink ribbon is simplified and, since the ribbon is retracted back into the cartridge when completely used, loading and unloading of cartridges to and from the printer is also simplified.

Figure 9:
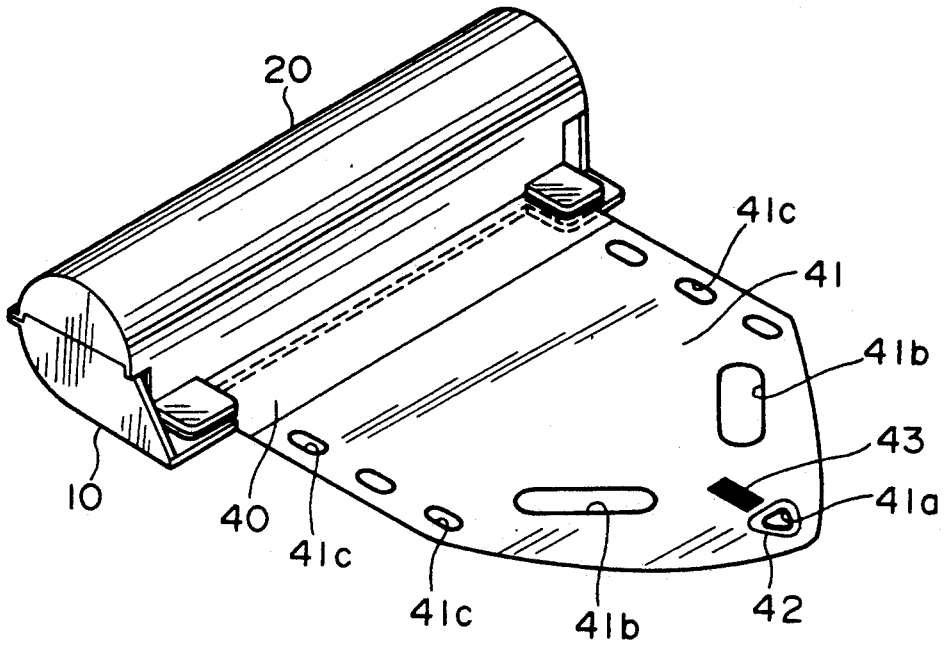
FIG. 9 is a perspective view showing a modification of a pull sheet for an ink ribbon employed in the cartridge of the invention.

FIG. 9 shows a further modification of the pull sheet of FIG. 1. According to this modification, lock openings 41*c* are provided on each side of the pull sheet 41 for preventing slippage of the pull sheet 41 during printer operation.

Figure 10:
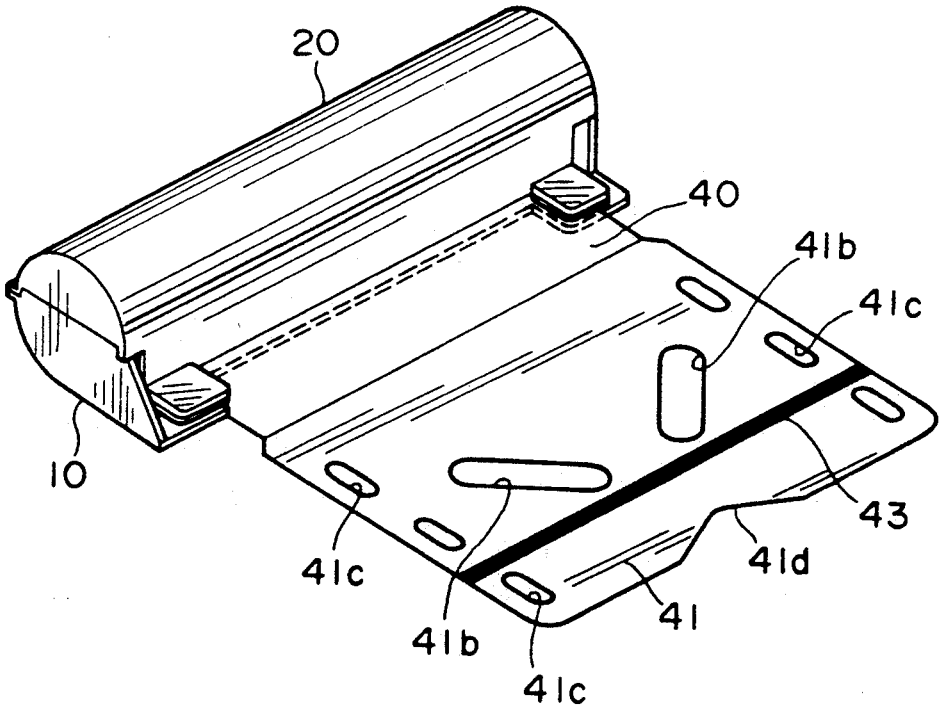
FIG. 10 is a perspective view showing a second embodiment of a pull sheet.

FIG. 10 shows a second embodiment of the pull sheet of the invention. Referring to FIG. 10, it can be seen that a straight leading edge of the pull sheet has been adopted, the straight leading edge having a v shaped cut-out 41*d* therein. As in the previous embodiment, lock openings 41*c* are provided as well as the cut-outs 41*b* for preventing creasing of the ink ribbon 40. Further, according to this embodiment, the marker 43 comprises a straight line parallel to the leading edge of the pull sheet 41 extending along the entire width of the pull sheet 41. According to this arrangement, chucking may be accomplished via the lock openings, for example, and the same advantages as found in the first embodiment are available.

Figure 11:
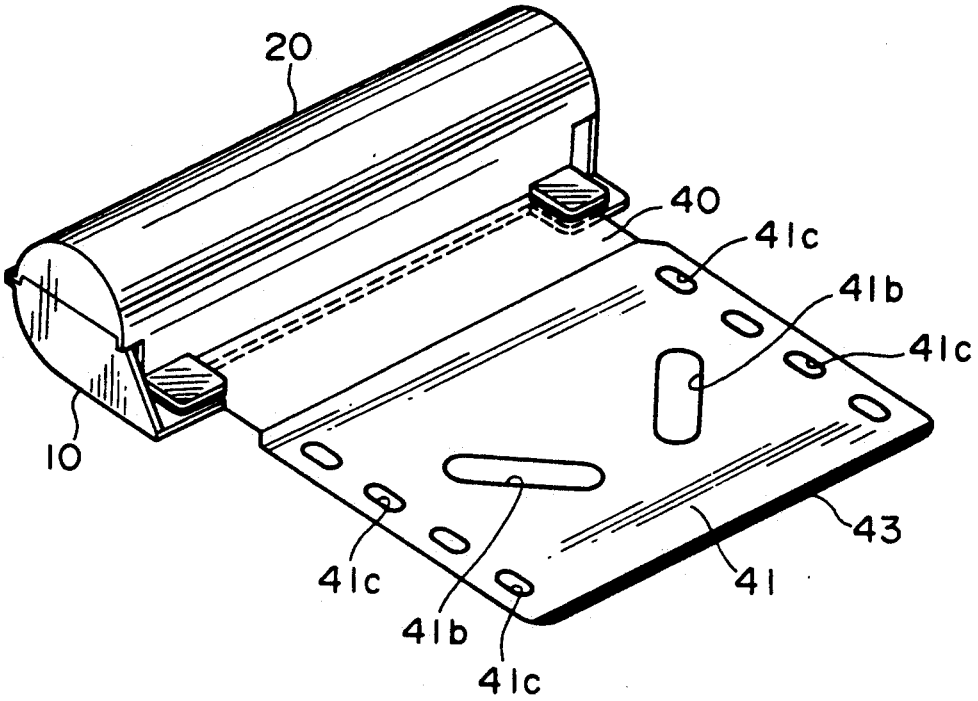
FIG. 11 is a perspective view showing a third embodiment of a pull sheet.

FIG. 11 shows a third embodiment of a pull sheet according to the invention. As may be seen, the third embodiment employs a marker 43 which comprises the leading edge of the pull sheet. As in the previous embodiment, the leading edge is straight and chucking may be accomplished via the lock openings, for example.

Figure 12:
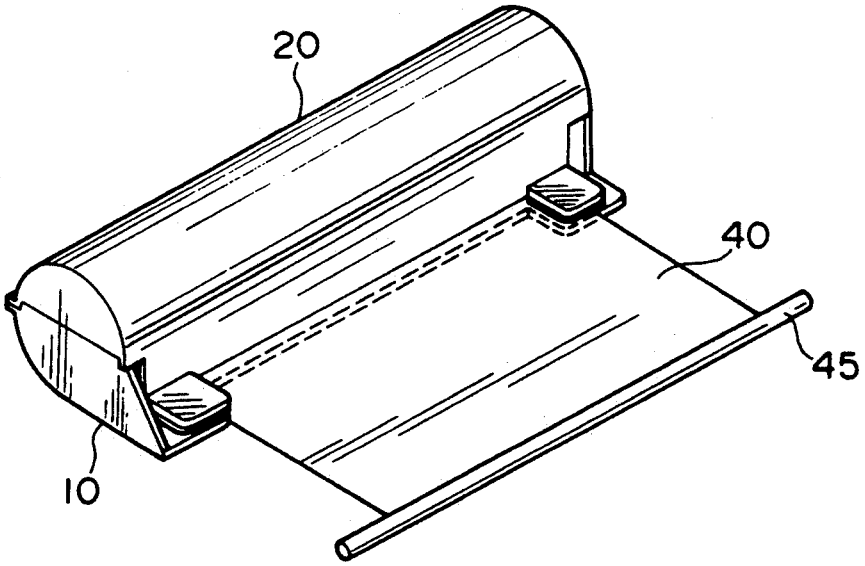
FIG. 12 is a perspective view of a pull bar which may alternatively be employed in the ribbon cartridge of the invention.
Figure 13:
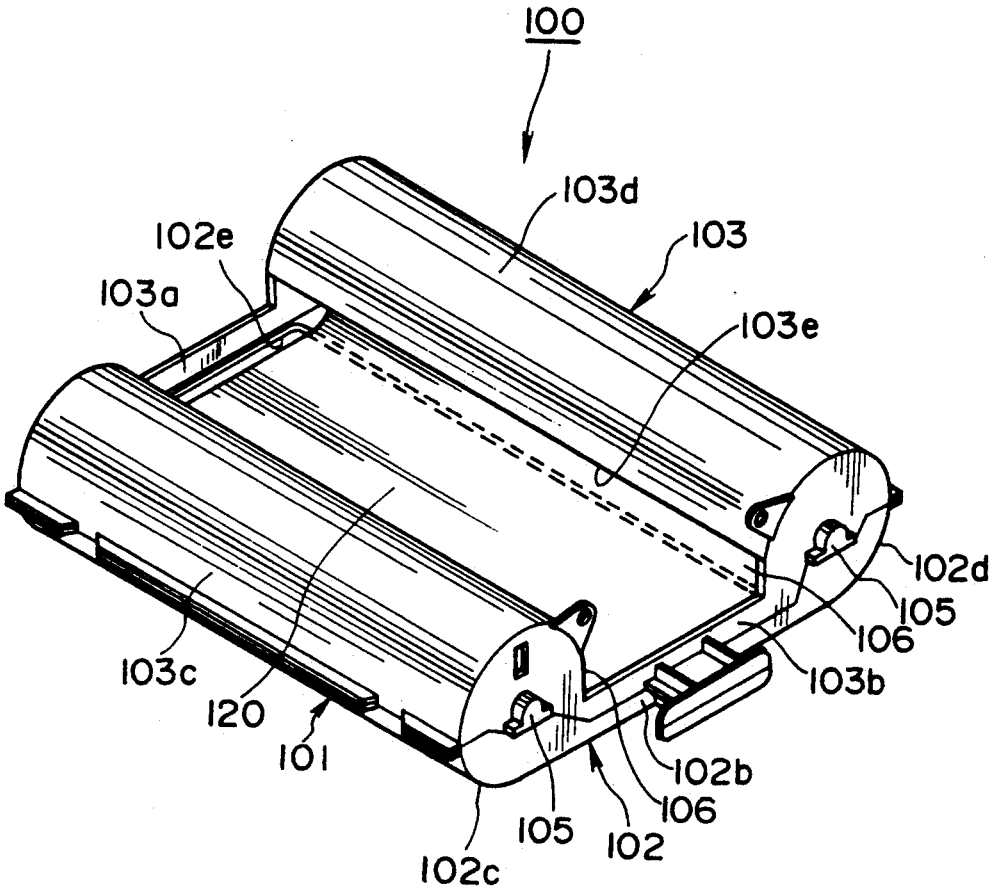
FIG.13 (PRIOR ART)
FIG. 13 is a perspective view of a conventional ribbon cartridge.
Figure 14:
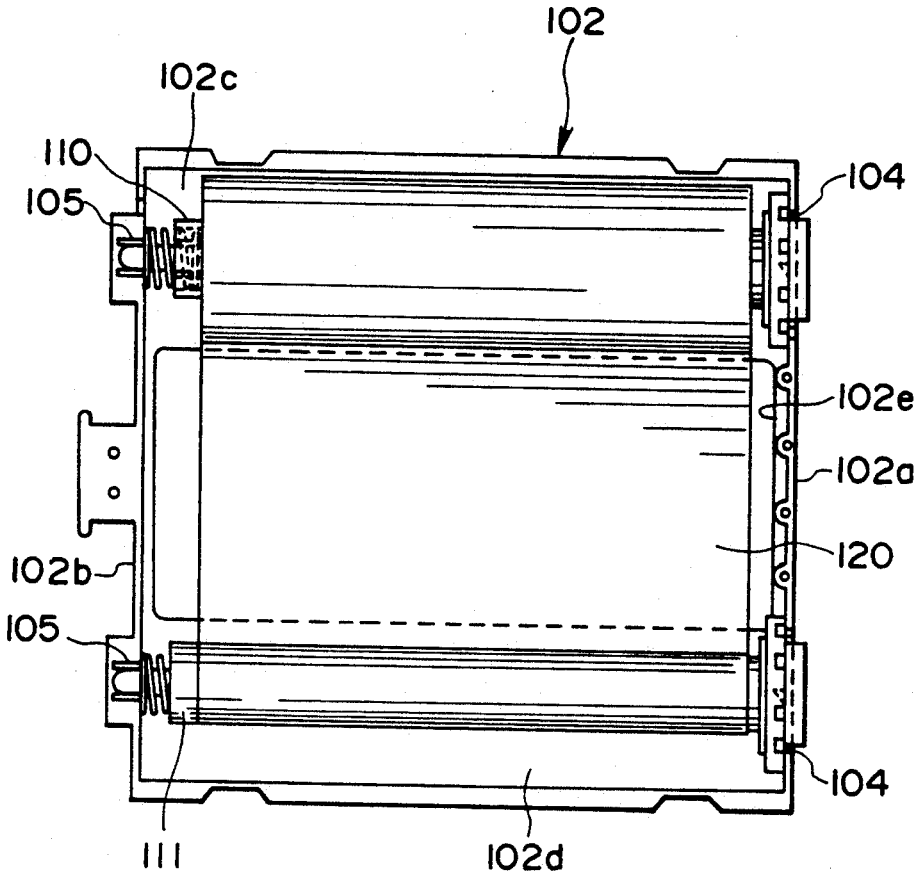
FIG.14 (PRIOR ART)
FIG. 14 is a plan view of the conventional cartridge of FIG. 13.

FIG. 12 shows an alternative construction of the ribbon cartridge according to the present invention. According to this construction, a pull bar 45 is utilized rather than a pull sheet. With this arrangement, the pull bar may be extracted from the cartridge body and, since the ink ribbon 40 is held straight, smooth extraction without creasing of the ink ribbon 40 may be accomplished. Further, the pull bar 45 itself may act as a marker for detection by the sensor (not shown) provided in the printer 50. Also, the pull bar arrangement fulfills all the objects of the pull sheet arrangements and further reduces the cost and complexity of manufacturing of the ribbon cartridge 1.

Thus according to the present invention, all the advantages as discussed above are available and, since the ink ribbon is not exposed to the ambient environment until required for printing, occurrence of distortion or degraded image quality due to dust etc., is avoided. Also, since the ink ribbon is wound back onto the supply reel after use, traces left on the exposed ribbon cannot be seen and the security of images produced by the ribbon cartridge is preserved.

While the present invention has been disclosed in terms of the preferred embodiment in order to facilitate better understanding thereof, it should be appreciated that the invention can be embodied in various ways without departing from the principle of the invention. Therefore, the invention should be understood to include all possible embodiments and modification to the shown embodiments which can be embodied without departing from the principle of the invention as set forth in the appended claims.

What is claimed is:

1. A ribbon cartridge, comprising:

an upper casing including ribbon guide means projecting therefrom in an extraction direction of ink ribbon to be employed in said cartridge;

a lower casing, including ribbon guide means projecting therefrom in said extraction direction and corresponding positionally with said ribbon guide means of said upper casing, said upper and lower casings joinable to form a substantially cylindrical cartridge body;

a ribbon supply reel rotatably mounted between and longitudinally enclosed by said upper and lower casings;

biasing means for exerting axial force against said ribbon supply reel in a predetermined direction;

an ink ribbon, wound around said ribbon supply reel;

a ribbon supply opening defined between said ribbon guide means of said upper and lower casings;

extraction enabling means affixed to an outer, exposed end of said ink ribbon, said extraction enabling means projecting outside of said cartridge body in an initial arrangement of said ribbon cartridge;

chucking means associated with said extraction enabling means; and anti-creasing means associated with said extraction enabling means.

2. A ribbon cartridge as set forth in claim 1, wherein said ribbon supply reel is exposed to the outside of said cartridge body at one axial side thereof, said one side being a side in the direction in which said biasing means is oriented, said one side further having a depression formed therein containing rib portions engagable with portions of a printer apparatus and, further having an annular ridge portion, said ridge portion having a predetermined number of circumferentially cut outs spaced circumferentially therearound, rib portions being formed at an inside of said upper and lower casing members so as to be engageable with said circumferential cut-outs of said ridge portion at said one side of said supply reel.

3. A ribbon cartridge as set forth in claim 1, wherein said extraction enabling means comprises a pull sheet attached to a leading edge of said ink ribbon, said pull sheet of substantially the same width and thickness as said ink ribbon.

4. A ribbon cartridge as set forth in claim 3, wherein said chucking means is an opening formed in said pull sheet.

5. A ribbon cartridge as set forth in claim 4, further including ring members surrounding said opening at both top and bottom surfaces of said pull sheet.

6. A ribbon cartridge a set forth in claim 4, wherein said opening is triangular.

7. A ribbon cartridge as set forth in claim 6, wherein said further including triangular ring members surrounding said triangular opening at both top and bottom surfaces of said pull sheet.

8. A ribbon cartridge as set forth in claim 3, wherein a leading edge of said pull sheet is V-shaped.

9. A ribbon cartridge as set forth in claim 3, wherein said anti-creasing means comprises longitudinal openings angled toward a center of a width portion of said pull sheet.

10. A ribbon cartridge as set forth in claim 1, wherein resilient members are affixed at each side of one of the facing surfaces of said ribbon guide portions of said upper or lower casings.

11. A ribbon cartridge as set forth in claim 3, wherein said pull sheet further includes lock openings spaced along each side of said pull sheet.

12. A ribbon cartridge as set forth in claim 3, wherein said said pull sheet is made of polyester.

13. A ribbon cartridge as set forth in claim 1, further including a shelf portion extending horizontally outward of a rear outer surface of said cartridge body.

14. A ribbon cartridge as set forth in claim 1, further including a marker in the vicinity of said chucking means.

15. A ribbon cartridge as set forth in claim 3, wherein said leading edge of said pull sheet is straight and a marker is provided longitudinally along said leading edge.

16. A ribbon cartridge as set forth in claim 3, wherein said leading edge of said pull sheet is straight with an inverted V-shaped cut-out defined at a center portion thereof, a marker being provided rearwards of said cut-out.

17. A ribbon cartridge as set forth in claim 1, wherein said biasing means is a coil spring mounted coaxially with an side of said ribbon supply reel opposite said one side.

18. A ribbon cartridge as set forth in claim 1, wherein said extraction enabling means, said chucking means and said anti-creasing means comprise a straight bar attached to said outer, exposed end of said ink ribbon.

* * * * *